US006298897B1

(12) United States Patent
Metcalf et al.

(10) Patent No.: US 6,298,897 B1
(45) Date of Patent: Oct. 9, 2001

(54) CONTROL WAND FOR COVERINGS FOR ARCHITECTURAL OPENINGS

(75) Inventors: Darrell J. Metcalf, Fillmore; Clyde L. Tichenor, Somis; Irwin Ginsburgh, Newhall, all of CA (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 0 days.

(21) Appl. No.: 09/562,576

(22) Filed: May 1, 2000

Related U.S. Application Data

(62) Division of application No. 08/993,643, filed on Dec. 18, 1997, now Pat. No. 6,089,303.
(60) Provisional application No. 60/033,410, filed on Dec. 18, 1996.

(51) Int. Cl.[7] ..... E06B 9/38
(52) U.S. Cl. ..... 160/177 R; 160/176.1 R; 74/89.15
(58) Field of Search ..... 160/176.1 R, 176.1 V, 160/177 R, 177 V, 178.1 R, 178.1 V, 900, 906; 74/89.15

(56) References Cited

U.S. PATENT DOCUMENTS

| | | | | |
|---|---|---|---|---|
| 1,025,982 | * | 5/1912 | Johnson | 74/89.15 |
| 2,575,479 | | 11/1951 | Wilt et al. . | |
| 4,759,398 | | 7/1988 | Renee . | |
| 4,817,698 | | 4/1989 | Rossini et al. | 160/107 |
| 5,476,132 | | 12/1995 | Jacobson . | |
| 5,787,953 | * | 8/1998 | Jacobson . | |
| 6,044,890 | * | 4/2000 | Renee . | |
| 6,089,303 | * | 7/2000 | Metcalf et al. . | |

FOREIGN PATENT DOCUMENTS

| | | |
|---|---|---|
| 629107 | 10/1961 | (CA) . |
| 153833 | 3/1956 | (SE) . |

* cited by examiner

*Primary Examiner*—Blair M. Johnson
(74) *Attorney, Agent, or Firm*—Dorsey & Whitney LLP

(57) ABSTRACT

A system for reversibly rotating a shaft for operation of the control system in a covering for an architectural opening includes two relatively linearly moveable members at least one of which has a low friction component engaging a helical path on the other so that linear movement of the members causes relative rotation to drive the rotatable shaft of the control system.

19 Claims, 7 Drawing Sheets

CONTROL WAND FOR COVERINGS FOR ARCHITECTURAL OPENINGS

CROSS-REFERENCE TO RELATED APPLICATIONS

The present application is a divisional of U.S. utility application Ser. No. 08/993,643, filed Dec. 18, 1997 now U.S. Pat. No. 6,089,303 for "Control Wand for Coverings for Architectural Openings, allowed, which claims priority to provisional application Ser. No. 60/033,410, filed Dec. 18, 1996 for "Quick Adjustment Device for Mini-Blinds." The '643 and '410 applications are hereby incorporated by reference as though fully set forth herein.

BACKGROUND OF THE INVENTION a. Field of the Invention

The present invention relates generally to retractable coverings for architectural openings and, more particularly, to an improved easy to manipulate wand for adjusting such coverings.

b. Description of the Relevant Art

Retractable coverings for various architectural openings such as windows, doorways, archways, and the like typically include a retractable barrier which might be a drapery, miniblind, vertical blind, or the like. Such retractable coverings have control systems that may be operated by pull cords or wands with wands typically being used in coverings having vertical or horizontal vanes or slats which are tilted or pivoted about their longitudinal axes by rotation of the wand.

The use of wands in coverings for architectural openings are desirable in that they avoid problems associated with endless loop cords such as children having body parts caught in the cord. Of course, with wands, accidents of this type cannot happen but wands have the disadvantage of sometimes being difficult to manipulate by individuals with arthritis or other infirmities in their hands. Wands are typically of a small diameter (less than ½") and since they must be rotated about their longitudinal axis, the operator of the covering of necessity needs to grip a relatively small rod and rotate that rod with the use of the fingers which becomes increasingly difficult with age.

Attempts to overcome the aforenoted problems are evident in several patented references such as U.S. Pat. No. 4,759,398 issued to Renee. The patent to Renée discloses an operating system for a venetian blind wherein a wand is made of an extruded synthetic resin and is, by way of example, hexagonal in cross section. The wand has been caused to assume a helical shape so that all six surfaces of the wand are helical. An operating element is slidably disposed on the wand and includes a portion that interfaces with the helical faces of the wand so that upon linear sliding movement of the operating element along the length of the wand, the wand is caused to rotate thereby negating the necessity of an operator having to twist the wand. A drawback with the system disclosed in the Renee patent resides in the fact that the entire length of the wand is helical and the control element slides along the total length of the wand which may be an undesirable feature of the system from an expense and aesthetic standpoint.

A system similar to the Renée system is shown in U.S. Pat. No. 5,476,132 issued to Jacobson only in this system, there are two helical wands with controlling elements slidable along the length of the wands to operate the system. This patent, of course, compounds the expense and aesthetic problems mentioned in connection with the Renée system.

Swedish Patent No. 153,833 issued to Bierlich discloses still another system for rotating a wand wherein a portion of the wand has been twisted to form helical surfaces and an outer tube is longitudinally slidable relative to the twisted wand. The outer tube has an interior partition with a square opening therethrough so that as the helical surface of the wand is advanced through the square opening the wand is forced to rotate relative to the outer tube which is held by an operator and slid axially of the twisted wand. This device has the disadvantage of requiring a pitch on the helically twisted rod that is very steep in order to make the device operate with a reasonable sliding force thereby requiring a number of reciprocating asses of the tube relative to the wand in order to affect an operation of the device. It further as a complex and thus expensive gear and brake mechanism to facilitate its operation.

It is to provide a device that makes a wand easy to manipulate and that overcomes the shortcomings in the prior art that the present invention has been developed.

SUMMARY OF THE INVENTION

The control wand system of the present invention includes longitudinally slidable component parts, one of which includes a relatively short helical guide path and the other a compact follower adapted to move along the guide path so as to establish relative rotational motion between the two parts. The follower has been designed to have a low friction relationship with the guide path so that the pitch of the helical guide path can be very shallow so that slats or vanes in a covering for an architectural opening can be desirably pivoted with a very short linear stroke of one component part relative to the other.

In one embodiment, an outer elongated but compact shell has a helical path formed along an internal wall and an elongated rod has a follower formed thereon having a portion of a helical rib which interfaces with the helical path in the outer shell so that a smooth sliding interface is established between the rod and the outer shell. In this manner, the shell and the rod can be moved axially or linearly relative to each other while generating a relative rotational movement of one of the members about its longitudinal axis. The member that is to be rotated is coupled to a rotatable shaft in the control system for the covering for the architectural opening so that linear movement between the rod and the shell effects a desired rotation of the rotatable shaft in the control system. Two different arrangements of this embodiment are illustrated with one arrangement having the outer shell coupled to the rotatable shaft of the control system, while in the other arrangement, the rod having the follower thereon is coupled to the rotatable shaft for unitary rotation therewith.

In another embodiment, a drive rod is coupled to the rotatable shaft of the control system and the drive rod is of non-circular cross section having been twisted to define a plurality of generally flat helical surfaces along a portion of the length of the rod. An outer hollow compact shell surrounds the helical portion of the drive rod and an intermediate hollow shell is positioned between the drive rod and the outer shell. The intermediate shell is axially and linearly movable relative to the drive rod and the outer shell and carries thereon a plurality of rotatable bearing members which utilize the drive rod as an inner race and the outer shell as an outer race so that the intermediate shell is easily linearly movable relative to the drive rod and imparts a rotating motion to the drive rod upon relative axial movement. The bearings, of course, provide a low friction interface between the two axially movable members so that a relatively shallow pitch can be provided to the helical surfaces to achieve the desired rotation of the drive rod in a very short linear stroke of the intermediate shell.

In still another embodiment, a drive rod is coupled to the rotatable shaft of the control system for unitary rotation therewith and has a helical guide surface formed on a portion thereof. An elongated shell surrounds the helical guide path of the drive rod with the shell being anchored to a support surface adjacent to the architectural opening. The elongated shell has a vertical slot formed therein and a drive pin slidably disposed within the slot is adapted to selectively engage the guide path on the drive rod so that vertical sliding movement of the drive pin within the slot of the shell effects a rotation of the drive rod which, in turn, rotates the rotatable shaft of the control system.

Other aspects, features, and details of the present invention can be more completely understood by reference to the following detailed description of a preferred embodiment, taken in conjunction with the drawings and from the appended claims.

DESCRIPTION OF THE PREFERRED EMBODIMENTS

Figure 1:
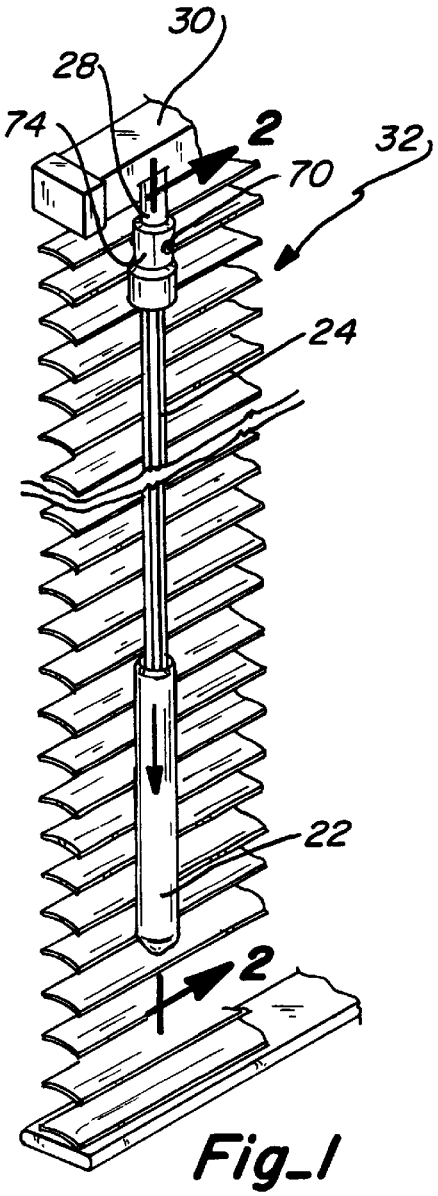
FIG. 1 is a fragmentary isometric view of a first arrangement of the control wand of the present invention incorporated into a venetian blind-type covering with the control wand in a lowered position.

Referring to FIGS. 1 through 4 and 8 through 11, a first arrangement 20 of a first embodiment of the wand of the present invention is seen to include an elongated outer shell 22, a drive rod 24 and a guide member or follower 26 secured to the drive rod for operative engagement with the outer shell The drive rod and outer shell are coaxially aligned and designed so that axial sliding movement of the shell effects a rotating movement of the rod. The rod is, in turn, operatively connected with a rotatable shaft 28 of the control system 30 that is incorporated into the covering 32 for an architectural opening so that rotation of the drive rod 24 effects a corresponding rotation of the rotatable shaft 28. Rotation of the rotatable shaft, for example, will in a conventional manner pivot the vanes 29 in a mini-blind covering about their longitudinal axes.

Figure 8:
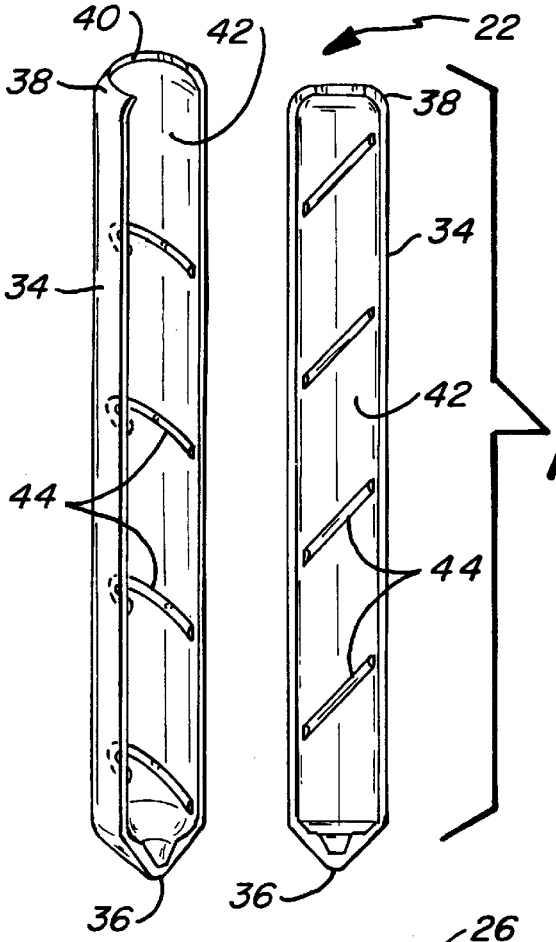
FIG. 8 is an exploded isometric view of the two halves of the shell of the control wand of FIG. 1.
Figure 10:
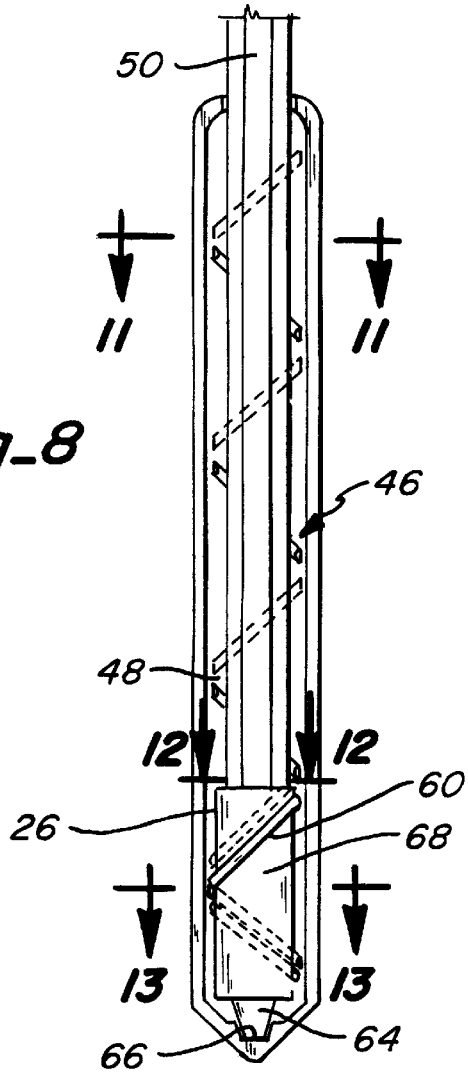
FIG. 10 is an enlarged fragmentary vertical section taken through a portion of the control wand of FIG. 1.
Figure 11:
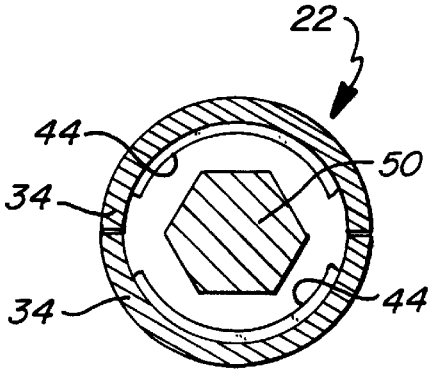
FIG. 11 is an enlarged section taken along line 11—11 of FIG. 10.
Figure 12:
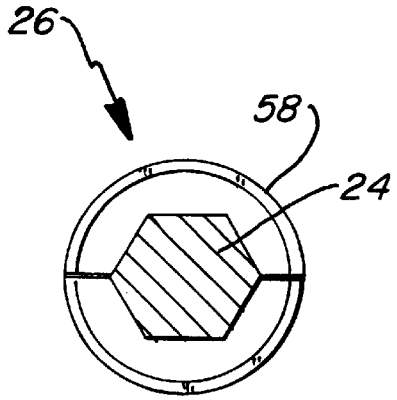
FIG. 12 is an enlarged section taken along line 12—12 of FIG. 10.
Figure 13:
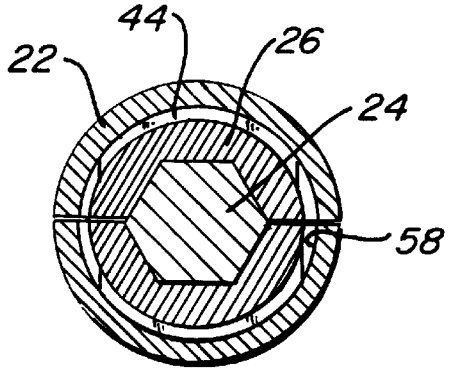
FIG. 13 is an enlarged section taken along line 13—13 of FIG. 10.

The elongated shell 22 could be formed in various ways such as plastic molding of an integral body, but in the disclosed embodiment, it consists of two hollow shell halves 34 as best illustrated in FIG. 8, with the shell halves being generally semi-cylindrical in configuration. The shell halves have a pointed or semi-conical closed end 36 and a blunt open 38 end defining a semi-circular opening 40 of slightly greater diameter than that of the drive rod 24. An interior semi-cylindrical wall 42 of each shell half has a plurality of integral rib segments 44 which are formed along a helical path or guide surface. The rib segments 44 in each half of the shell are axially offset so that when the shell halves are placed in face-to-face relationship as seen in FIG. 10, the rib segments cooperate in defining a helical path 46 along the length of the shell. Depending upon the length of the rib segments 44 formed in each half of the shell, the helical rib in the enclosed shell will be continuous or interrupted. In other words, if the rib segments in each shell half extend fully from one side edge of the shell half 34 to the opposite side edge, when the shell halves are placed in confronting face-to-face relationship and joined together, the resultant helical rib will be continuous. On the other hand, if the rib segments were made so as not to fully extend from one side edge to the other of the shell half 34, then the resultant helical rib or path 46 would be interrupted along its length defining gaps 48 between rib segments of the helical rib. The pitch of the ribs are preferably in the range of 30 to 60 degrees relative to the longitudinal axis of the shell and as will be appreciated, the helical path defined by the ribs passes through the minimum number of revolutions necessary to control either a desired range, or a full range of operation, e.g., in the disclosed arrangement four complete revolutions of the helical path effects three to four revolutions of the rotatable shaft 28 of the control system. The length of the helical rib 46 will vary depending upon the pitch, the number of revolutions in the helix and its diameter, but in the preferred embodiment the length of the helix is only about three and one half to four inches and will effect rotation of the vanes in a conventional mini-blind or vertical blind coveting through approximately 90°. Of course, the halves 34 of the shell can be secured together in any suitable manner such as with fasteners, adhesive, sonic welding or the like. When secured together they define a cylindrical cavity that includes the helical rib, a circular opening at the top to slidably receive the drive rod, and a conical lower end defining a reduced surface area at the lower end for a purpose to be described later.

The drive rod 24 has a shaft portion 50 and the guide follower portion 26 with the shaft portion being elongated and preferably of non-circular transverse cross section. In the disclosed embodiment, the cross section is hexagonal. The guide follower 26 is a collar received on the lower end of the shaft 50 and secured thereon for unitary movement with the shaft. The guide follower in the disclosed embodiment is composed of two generally semi-cylindrical members 54 which, when joined in abutting face-to-face relationship, define a hexagonal cavity 56 adapted to matingly receive the lower end of the shaft 50. Each member 54 of the guide follower includes an externally projecting rib segment 58 that defines a portion of a helical guide surface or rib 60 (FIG. 10) and is at a pitch that corresponds with the pitch of the helical rib 46 in the shell 22. The external rib segments 58 are offset relative to each other so that when the members 54 are positioned in face-to-face abutting relationship, the rib segments 58 substantially define one revolution of a helical path. As with the shell 22, the rib segments can extend completely from one side to the other of the members 54 on which they are disposed, or can extend less than the complete width of the member. If the rib segments extend the full width of a member, when the members are placed in abutting relationship, the rib segments will cooperate in defining one complete revolution of the helical rib 60. If the segments are less than the complete width of the associated member, then they will form segments of one revolution of a helical rib. It is important that if the helical path 46 in the shell 22 is discontinuous so that gaps 48 are provided between rib segments of the helical rib, then the ribs 58 on the guide follower must be longer than the gap between rib segments in the shell for reasons that will become apparent hereafter. Again, the members 54 of the guide follower can be secured together in any suitable manner such as with fasteners, adhesive, sonic welding or the like.

Each half or member 54 of the guide follower 26 has an axial projection 62 from one end and is open at the opposite end with the projection on each member cooperating with the corresponding projection on the other member to define a frustoconical projection 64 from the guide follower which projects axially downwardly from the lower end of the shaft 50. The frustoconical projection is adapted to be frictionally but releasably received in a similarly configured recess 66 in the closed end of the shell 22. In this manner, when the shaft is extended completely into the shell, the projection 64 is frictionally but releasably retained in the recess 66 so that the shell and drive rod are releasably held in a fixed position relative to each other.

Figure 9:
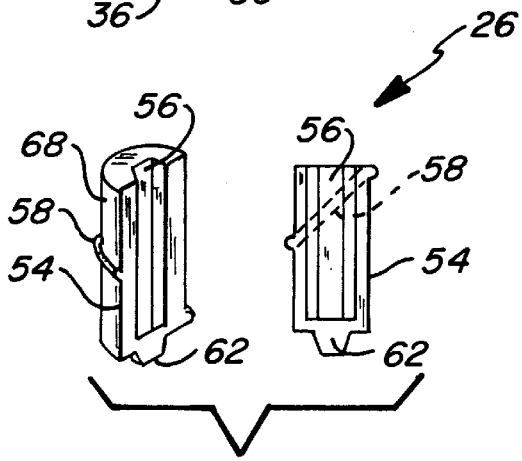
FIG. 9 is an exploded isometric of the two halves of the follower of the control wand of FIG. 1.

With reference to FIGS. 9 and 10, it will be appreciated that the guide follower 26 defines a cylindrical outer wall 68 that has a diameter slightly less than the internal diameter of the helical rib 46 in the shell 22 so that the guide follower is free to rotate within the shell. The helical rib segments 58 on the guide follower, however, project away from the outer cylindrical wall 68 a distance so as to overlap the helical rib 46 in the shell whereby the rib segments on the guide follower can engage and slide along the helical rib in the shell as the drive rod is moved axially of the shell thereby effecting rotational movement of the drive rod 24. The helical rib segments in the shell and on the guide follower can be made of or coated with low friction material such as Teflon® so that the drive rod rotates easily relative to the shell upon axial sliding movement of the shell.

The upper end of the drive rod 24, as mentioned previously, is coupled to the rotatable shaft 28 of the control system 30 for the covering 32 and the rotatable shaft is provided with a transverse opening 70 for receiving a connecting pin 72. When so configured, the drive rod is axially aligned with the rotatable shaft and placed in substantially abutting relationship with the rotatable shaft. A flexible sleeve 74 frictionally surrounds the upper end of the drive rod and the lower end of the rotatable shaft to retain a substantially axial alignment of the two elements even though a conventional universal coupling could also be used. The connection pin 72 extends through the sleeve 74, as well as the transverse opening 70 in the rotatable shaft, so that a connection of the drive rod and the rotatable shaft is established that provides unitary rotation between the drive rod and the rotatable shaft. The flexible sleeve can be any suitable material such as rubber, plastic, or the like, with the important element being that it grips both the rotatable shaft and the drive rod for unitary rotation. The upper end 76 of the drive rod is rounded into a hemispherical shape so that the drive rod can be pivoted slightly about its upper end relative to the rotatable shaft for ease of manipulation of the control wand. Regardless of the relative angle between the drive rod and the rotatable shaft, however, unitary rotation is achieved between the two elements.

Figure 2:
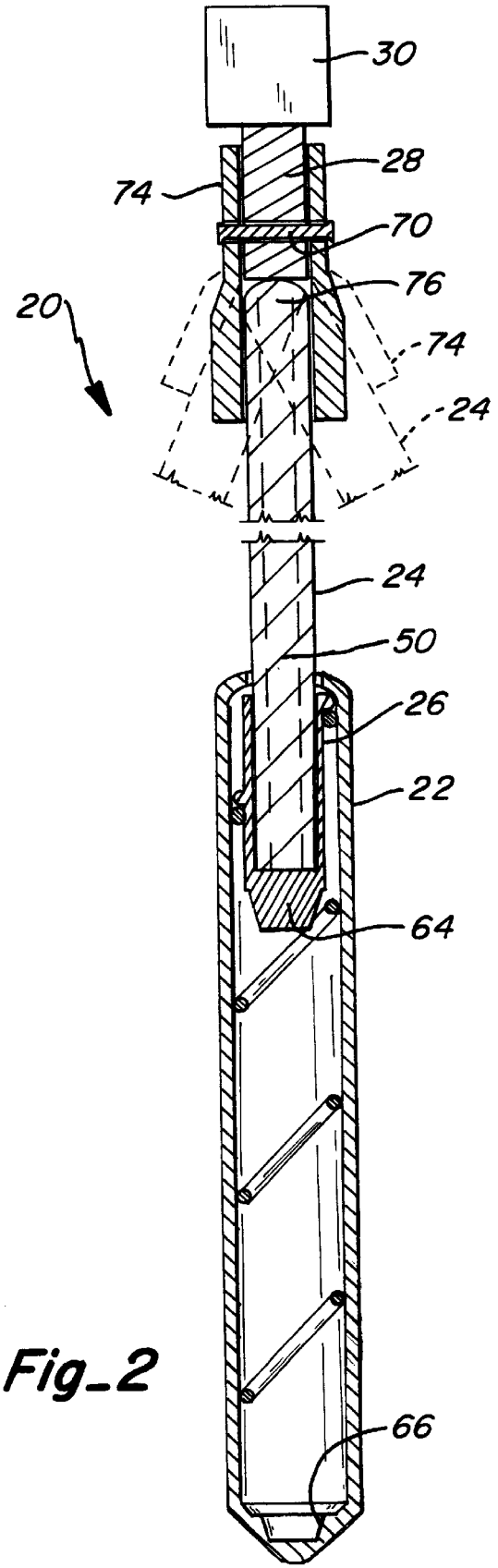
FIG. 2 is a fragmentary enlarged vertical section taken along line 2—2 of FIG. 1.
Figure 4:
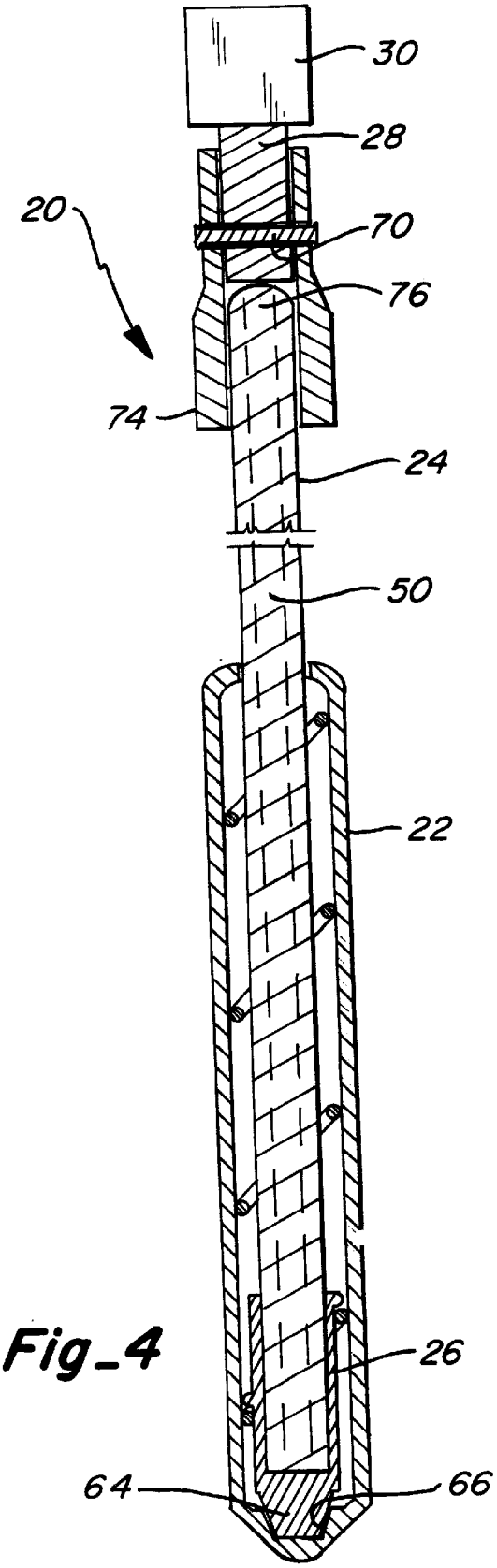
FIG. 4 is an enlarged fragmentary vertical section taken along line 4—4 of FIG. 3.

In operation of the device, an operator merely grips the shell 22 and moves it linearly upwardly from the position shown in FIG. 2 to the position shown in FIG. 4 thereby engaging the helical rib segments 58 on the guide follower with the helical rib 46 in the shell so as to effect rotation of the drive rod 24 in a first direction. Of course, for the reasons mentioned previously, rotation of the drive rod in that direction affects rotation of the rotatable shaft 28 of the control system in the same direction. Movement of the shell 22 linearly downwardly along the drive rod 24, of course, rotates the drive rod in the opposite direction and consequently the rotatable shaft of the control system in the opposite direction. In order to retain the shell in the raised position of FIG. 4, the lower frustoconical tip 64 of the guide follower is frictionally retained in the recess 66 in the shell thereby preventing gravity from moving the shell back to the lowered position of FIG. 2.

From the above, it will be appreciated that a certain predetermined number of rotations of the rotatable shaft 28 in the control system 30 can be achieved in opposite directions with a simple linear sliding movement of the shell relative to the drive rod. It can be achieved with minimal dexterity so that individuals with arthritic conditions or other infirmities can easily operate the system. Typically, wands are utilized to tilt slats or vanes in venetian blinds or vertical vane coverings for architectural openings so that a predetermined number of rotations of the rotatable shaft 28 in either direction pivots the slats or vanes up to a fill 180° range in a conventional manner. It will be appreciated that the tilting of the slats or vanes is very easily and quickly accomplished with the system as described.

Figure 3:
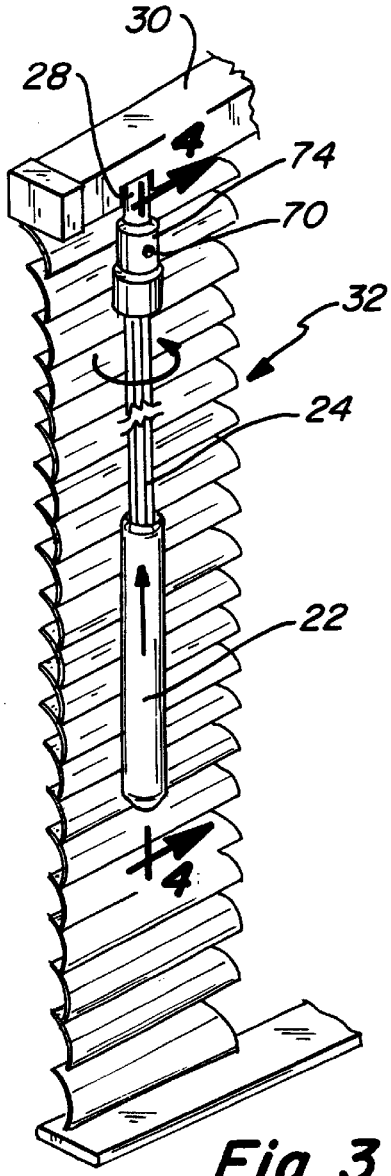
FIG. 3 is a fragmentary isometric similar to FIG. 1 with the control wand in a raised position.

Control systems for mini-blinds or vertical blinds are predesigned such that a predetermined number of rotations of the rotatable shaft 28 will pivot the vanes of a mini blind or vertical blind about their longitudinal axis through a predetermined number of degrees. For example, four complete revolutions of the rotatable shaft might pivot the slats through 90° or, depending upon the design of the control system, might pivot the slats through a full 180°. A full 180°, of course, moves the slats from a first closed position, through an open position, to a second closed position. In the closed positions, of course, the vanes are aligned in a substantially planar orientation, as shown in FIG. 3, forming a barrier through which vision and light are blocked. In an open position (FIG. 1) the slats extend parallel to each other defining gaps therebetween permitting the passage of vision and light.

It will be appreciated that with the present invention, the number of rotations of the drive rod 24 per linear stroke of the shell 22 necessary for rotating the slats through a predetermined number of degrees can be predetermined. By way of example, if the control system for a covering required four revolutions of the rotatable shaft to pivot the vanes through 90°, and it was desired that one complete linear stroke of the shell relative to the drive rod was desired to rotate the vanes through 90°, then four revolutions of the helix within the shell would be provided. If it was desired to have one linear stroke move the vanes through a full 180° of motion, then eight revolutions of the helix within the shell would be provided.

One desirable feature of the control wand of the present invention resides in the fact that if it is setup so that four revolutions of the rotatable shaft will pivot the vanes through 90°, reciprocating movement of the shell relative to the drive rod will reciprocatingly move the slats between a first closed position and the open position. If it is desirable to move the slats from their open position to the second closed position wherein the slats are tilted in the opposite direction from the first closed position but again oriented in a generally planar orientation to block the passage of vision or light, it is a very simple matter to manipulate the control wand so as to reset the control system for the covering so that the slats pivot between the open position and the second dosed position.

As mentioned previously, when the shell is moved to its lowermost position of FIG. 2, the slats are in the open position as shown in FIG. 1, and if the shell is gripped by an operator and moved upwardly a full stroke, the drive shaft will rotate and the vanes will pivot clockwise to the first closed position of FIG. 3. However, if the vanes are in the open position of FIG. 1 with the shell in its lowermost position of FIG. 2, an operator can merely press the palm of his hand against the reduced area conical lower end of the shell and push the shell upwardly so that it rotates within the palm and relative to the drive rod 24, whereby the position of the shell is changed from that of FIG. 2 to that of FIG. 4 without rotating the drive rod and, consequently, without changing the position of the vanes. In other words, the shell would then occupy the position of FIG. 4 but the vanes would still be open. Then, moving the shell downwardly, while gripping the shell to prevent its rotation will cause the vanes to pivot from the open position of FIG. 1 in a counter-clockwise direction to a second closed position which is not illustrated. From then on, linear movement of the shell up and down relative to the drive shaft while gripping the shell will pivot the vanes through 90° but through a different 90° arc than when the vanes are moved between the open position and the first closed position of FIG. 3. Of course, the control of the system can be reset to the original operating arrangement by reversing the above-noted procedure so that after the shell has been moved to the raised position illustrated in FIG. 4, the frictional grip between the frustoconical tip 64 and the recess 66 can be broken by a simple downward pressure on the shell and it will thereafter drop by gravity while rotating itself without rotating the drive rod. When changing the operating conditions of the system, it will be appreciated that due to the low friction relationship between the helical rib 46 and the rib 58 on the follower, and further because there is some resistance in the control system of the covering to rotation of the rotatable shaft, the shell will rotate freely relative to the drive rod unless it is gripped by an operator.

Figure 5:
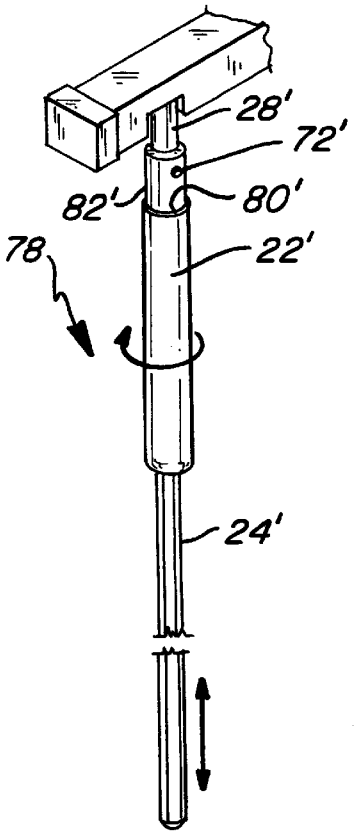
FIG. 5 is a fragmentary isometric showing a second arrangement of the control wand of the present invention with the wand in a raised position.
Figure 6:
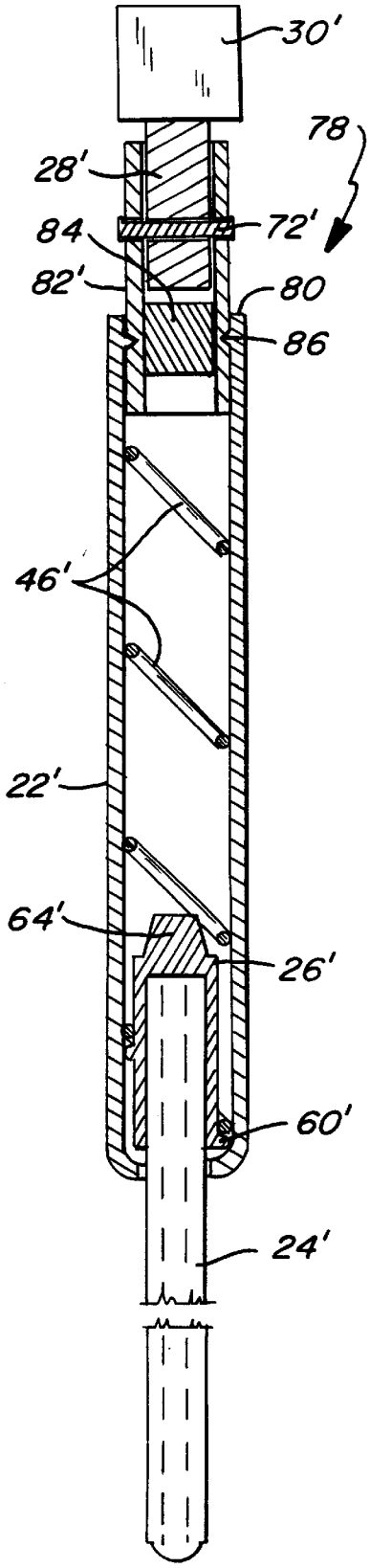
FIG. 6 is an enlarged fragmentary vertical section taken through the wand of FIG. 5 with the wand in a lowered position.
Figure 7:
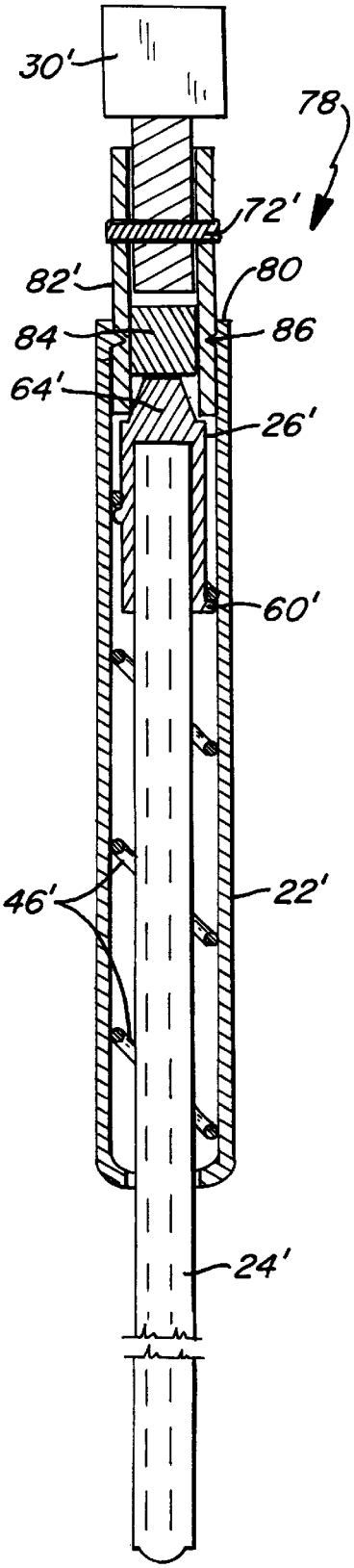
FIG. 7 is an enlarged fragmentary vertical section similar to FIG. 6 with the wand in a raised position.

Referring next to FIGS. 5 through 7, a second arrangement 78 of the first embodiment of the present invention is shown. In this arrangement, the drive rod 24' and shell 22' have been reversed so that the shell 22' is connected at its upper end to the rotatable shaft 28' of the control system 30' for the covering for an architectural opening and the drive rod extends downwardly from the shell for manipulation by an operator. For ease of description, corresponding parts of this arrangement with those of the first described arrangement have been given like reference numerals with a prime suffix.

In the arrangement shown in FIGS. 5 through 7, the drive rod 24' has a guide follower 26' on its upper end with a helical external rib 60' that could be continuous or segmented through one revolution as described with the first arrangement. The shell 22', similarly, has an inwardly directed helical rib 46' adapted to cooperate with the external rib segments 58' on the guide follower in effecting rotation of the shell upon axial sliding movement of the drive rod. The shell has an open upper end 80 secured to an internal collar 82 having a plug 84 therein so as to establish a friction fit between the collar and the shell 22' whereby the two components rotate in unison. A tongue and groove type connector 86 between the collar and the shell night also be employed as illustrated. The upper end of the collar surrounds the rotatable shaft 28' of the control system and a transverse pin 72' extends through the collar and the rotatable shaft so that rotation of the shell effects a corresponding rotation of the rotatable shaft.

When firmly held, movement of the drive rod 24' from its lowered position of FIG. 6 to its raised position of FIG. 7, causes the helical rib segments on the guide follower and the shell to interreact thereby causing the shell to rotate since the drive rod is held by an operator's hand and prevented from rotation. Rotation of the shell of course, rotates the rotatable shaft 28' of the control system in a first direction. Pulling the drive rod downwardly from the position of FIG. 7 to the position of FIG. 6, causes the shell to rotate in the opposite direction which, of course, causes the rotatable shaft of the control system to rotate correspondingly in the opposite direction. The upper end of the guide follower 26' has a frustoconical projection 64' which is adapted to be received and frictionally but releasably gripped by the lower end of the collar 82 to releasably retain the drive rod in the raised position of FIG. 7.

It will be appreciated that the drive rod itself can be manually rotated, like a conventional tilt wand, to operate the control system for the covering as an alternative to the linear reciprocating motion described above. Further, the angular movement of the vanes can be regulated as with the arrangement described previously by an operator abutting the palm of his hand against the reduced surface area rounded lower end of the drive rod to allow the drive rod to rotate relative to the shell as it is being moved upwardly. Of course, the reverse is also possible by releasing the frictional grip between the frustoconical upper end 64' of the follower 26' and the lower end of the collar 82 and allowing the drive rod to drop by gravity while rotating independently of the shell 22'.

With either of the first two described arrangements of the present invention, it will be appreciated that the helical rib segments on either the guide follower or the shell could be a groove with corresponding dimensional changes in the elements so that helical rib segments would ride within a helical groove to produce the same relative rotation between the members upon linear axial movement between the two.

Figure 16:
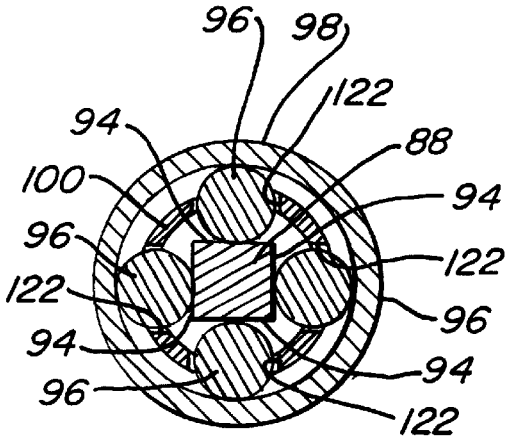
FIG. 16 is an enlarged section taken along line 16—16 of FIG. 15.
Figure 19:
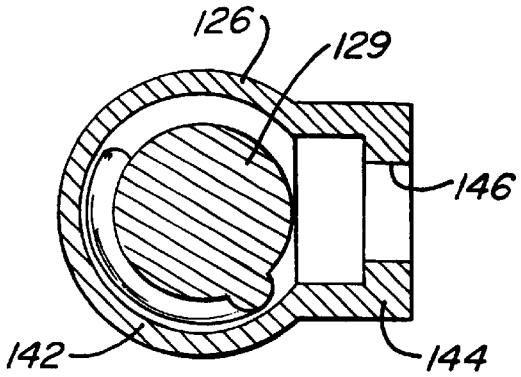
FIG. 19 is an enlarged section taken along line 19—19 of FIG. 18.
Figure 20:
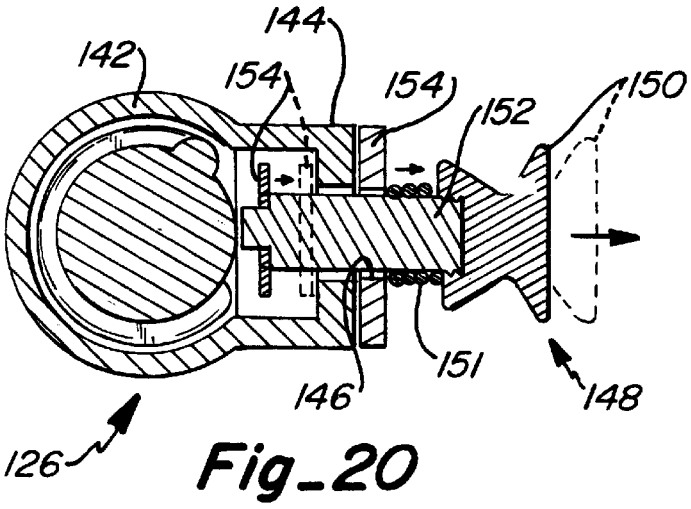
FIG. 20 is an enlarged section taken along line 20—20 of FIG. 18.
Figure 14:
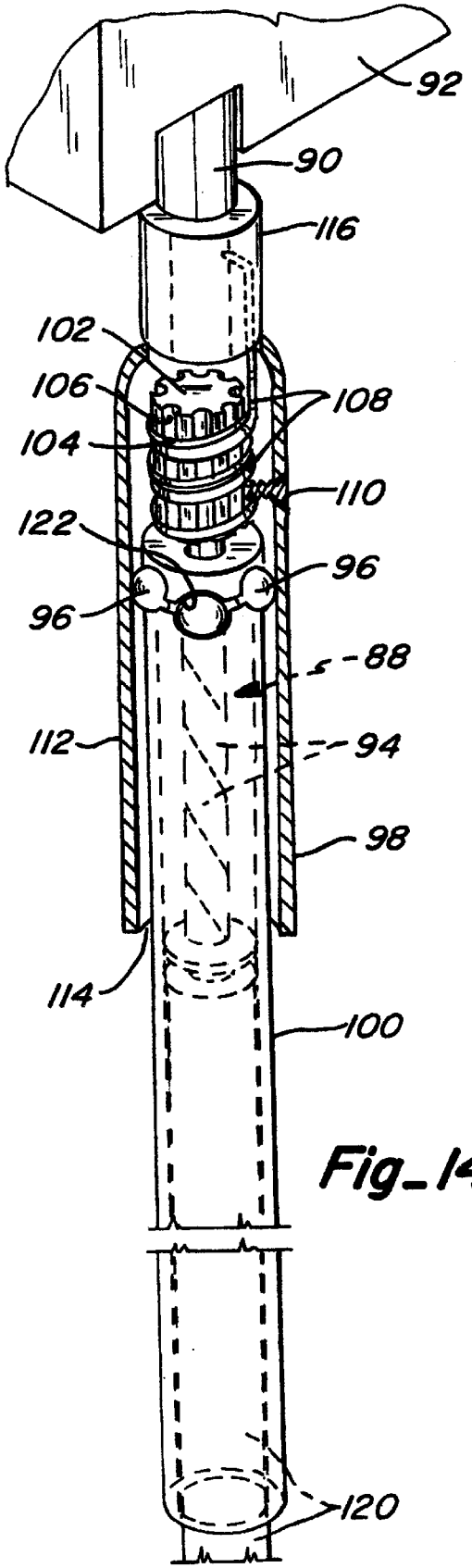
FIG. 14 is a fragmentary isometric that is partially sectioned illustrating another embodiment of the control wand of the present invention.
Figure 15:
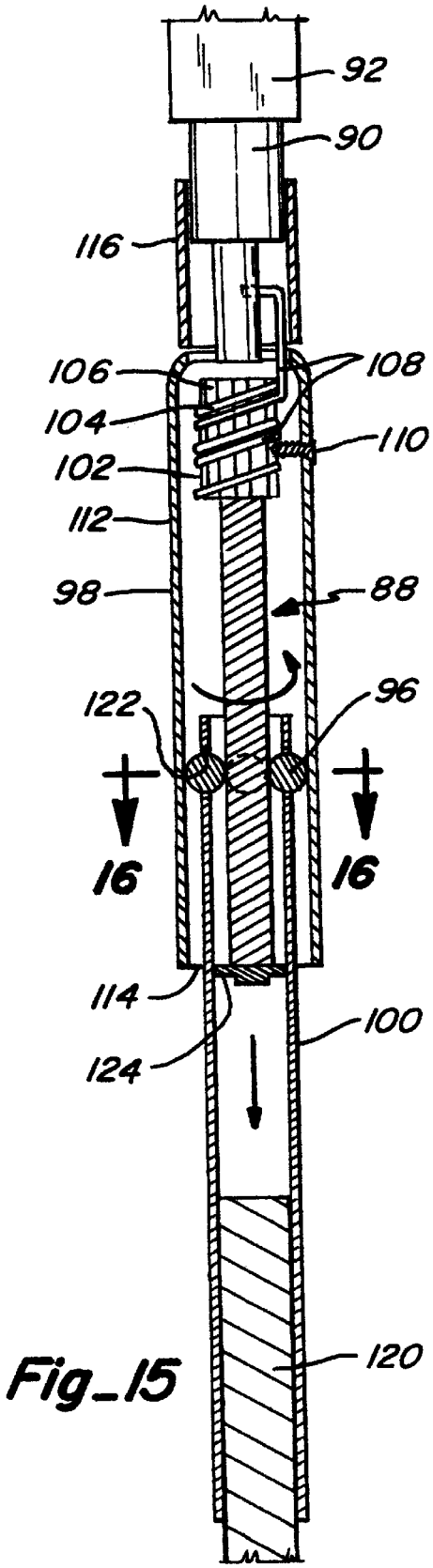
FIG. 15 is a fragmentary vertical section taken through the control wand of FIG. 14.
Figure 17:
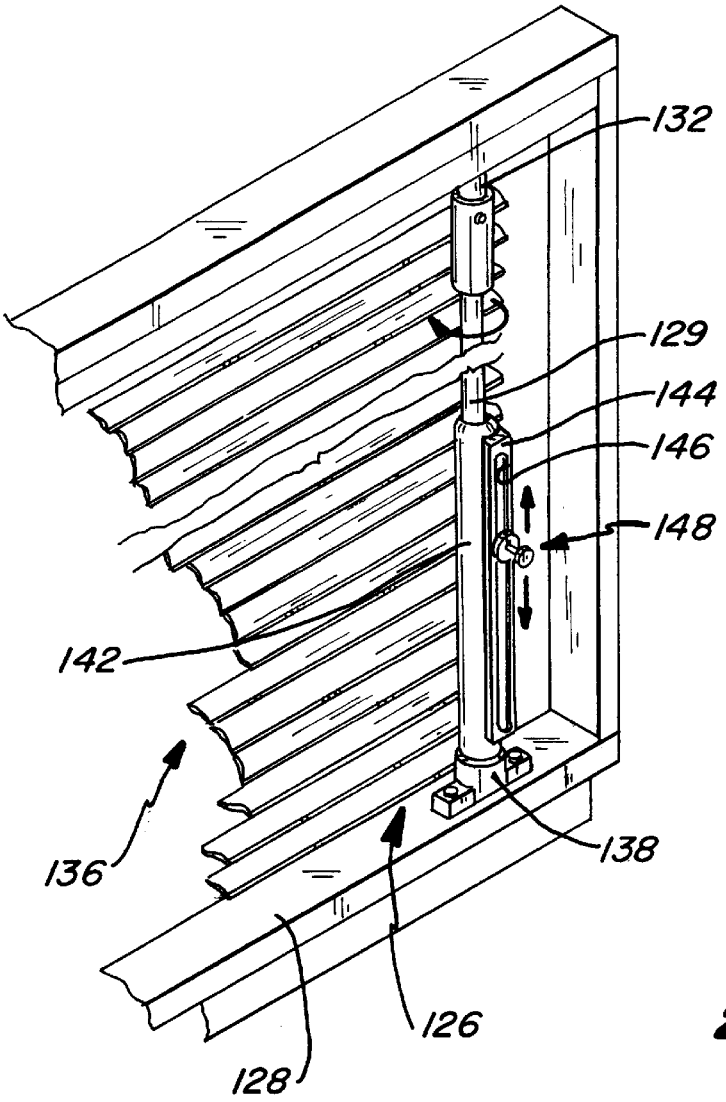
FIG. 17 is a fragmentary isometric of still another embodiment of the present invention shown in position for controlling a venetian blind-type covering.

Referring to FIGS. 14 through 16, another embodiment of the present invention is illustrated. In this embodiment, the drive rod 88 is operatively interconnected to the rotatable shaft 90 of the control system 92 for the covering and has a plurality of helical guide paths 94 defined along its length. The drive rod also serves as the inner race for a plurality of rotatable bearings 96 while an outer shell 98 that is concentric with the drive rod 88 serves as an outer race. The rotatable bearings, which in the disclosed embodiment are in the form of ball bearings, are rotatably supported on a linearly movable intermediate shell 100 positioned between the drive rod and the outer shell.

The drive rod 88 is preferably of twisted, square stock metal or plastic and can optionally include an enlarged cylinder 102 secured to its upper end. The four twisted sides of the drive rod define four helical guide paths 94 along the length of the drive rod. The cylinder 102, itself, has a protruding helical rib 104 and circumferentially spaced longitudinally extending grooves 106. A hook-and-coil combination 108 and a set screw 110 connect the cylinder 102 of the drive rod 88 to the rotatable shaft 90 of the control system 92 so that the drive rod and rotatable shaft can rotate in unison with each other as will be described hereafter. The hook-and-coil combination is made of any substantially rigid material and with the coil having a slightly larger internal diameter than the outside diameter of the cylinder 102 so as to be operatively engagable with the helical rib 104 and slidable about the cylinder 102. The hook at the top of the hook-and-coil combination is received in a transverse hole in the rotatable shaft 90 so that the hook-and-coil combination rotates in unison with the rotatable shaft.

The outer shell 98 has a substantially cylindrical main body 112 with an open lower end 114 and a cylindrical upwardly extending neck 116. The set screw 110 is threaded through the cylindrical main body 112 of the outer shell adjacent the upper end thereof and is adapted to be selectively received in any one of the longitudinal grooves 106 in the cylinder 102. Relative rotation between the enlarged cylinder 102 and the hook-and-coil combination 108 adjusts the longitudinal or axial relationship between the drive rod 88 and the outer shell 98. Subsequent to adjusting the axial relationship, the set screw can be tightened and advanced into one of the grooves 106 of the cylinder 102 to fix the relative axial relationship as desired. This adjustment is provided as it has been found that the amount of play between the wand system and the rotatable shaft 90 of the control system effects the desired operation of the system, but, depending upon various parameters, the desired spacing between the drive rod and the rotatable shaft will be different.

The intermediate shell 100 comprises a hollow cylinder that is connected to an elongated operating shaft 120 for unitary movement therewith. The shaft has its upper end frictionally received within the interior of the intermediate shell 100 and could be further secured in any suitable manner such as with adhesive, pins, or the like. The upper end of the intermediate shell has four circular openings 122 therethrough that are spaced 90° from each other and serve as seats for the ball bearings 96 that are positioned therein. The circumferential edge of each opening 122 is preferably cupped to help retain the associated ball bearing in the opening. The ball bearings, as mentioned previously, roll against the drive rod 88 as an inner race and the outer shell 98 as the outer race as the intermediate shell 100 is moved axially relative to the outer shell and the drive rod.

The lower end of the drive rod 88 has an enlarged disc 124 secured thereto which is preferably made of a low friction material and slides against the inner wall of the intermediate shell 100 to maintain a desired axial alignment of the intermediate shell with the drive rod 88 and the outer shell 98. The ball bearings further assist in retaining this alignment.

It will be appreciated with the above assemblage of parts that vertical movement of the intermediate shell 100 relative to the drive rod 88 will cause the drive rod to rotate relative to the intermediate shell and since the intermediate shell is prevented from rotation by the operator's hand, the drive rod will rotate thereby rotating the rotatable shaft 90 of the control system to operate the control system as desired. The ball bearings 96, of course, provide a low friction interface between the relatively moving parts so that a fairly shallow pitch can be provided on the helical path of the drive rod.

Still another embodiment of the present invention is illustrated in FIGS. 17 through 20. In this embodiment, a shell or stanchion 126 is anchored to a structural member such as a window sill 128 adjacent to the architectural opening, and the drive rod 129 protrudes reciprocally through an opening 130 in the top of the shell. The upper end of the drive rod is coupled to the rotatable shaft 132 of the control system 134 for the covering 136 for the architectural opening for unitary rotation therewith.

The shell or stanchion 126 includes a base 138 through which fasteners 140 can extend to secure the shell to the structural member 128 and a hollow generally cylindrical body 142 protruding upwardly from the base. The hollow cylindrical body 142 has a boss 144 formed vertically along one side with a vertical slot 146 in the boss. A drive pin 148 is slidably disposed in the slot and includes an enlarged head or knob 150, that can be grasped by the fingers of a user and an elongated shaft 152 having clip washers 154 secured thereto at spaced locations conforming to the thickness of the boss. The washers 154 thereby define slide surfaces allowing the drive pin 148 to be slid vertically within the slot 146. A compression spring 151 is positioned between the outer clip washer and the head 150 which biases the drive pin outwardly relative to the cylindrical shell 126 for a reason to be described hereafter.

The drive rod 129 is an elongated rod that could be of circular cross section and has a helical outwardly protruding rib 153 formed thereon and within the shell 126. The upper end of the drive rod is secured to the rotatable shaft 132 of the control system with a flexible friction grip collar 155 and a pin 156 that extends transversely through the collar and the rotatable shaft.

Figure 18:
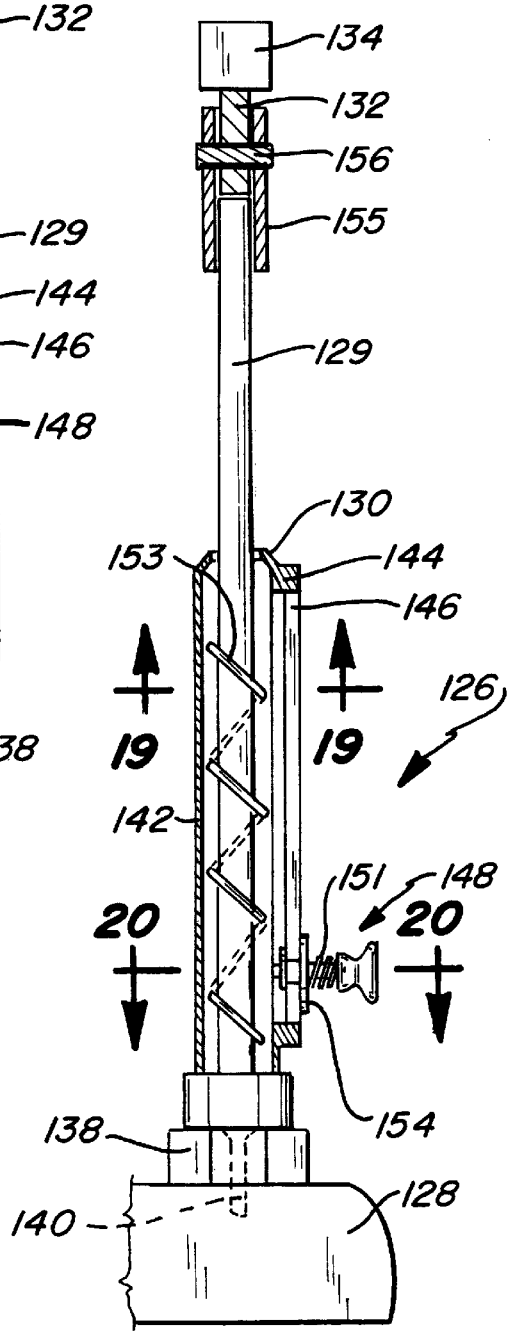
FIG. 18 is an enlarged fragmentary vertical section taken through the control wand of FIG. 17.

When the drive pin 148 is in its neutral retracted position as illustrated in FIG. 18, it can be slid up and down in the slot 146 without engaging the helical rib 153 on the drive rod 129, but by depressing the knob 150 against the bias of the coil spring 151, the inner end of the pin shaft 152 will engage the helical rib on the drive rod and rotate the drive rod in one direction when the drive pin is raised and in an opposite direction when it is lowered. Of course, rotational movement of the drive rod is transferred to the rotatable shaft of the control system as desired.

In each of the aforedescribed embodiments, the number of revolutions of the helical ribs and the pitch of the ribs can be within the aforedescribed ranges thereby allowing the slats or vanes of the window covering to be pivoted up to a full 180° degrees with a single linear stroke. As will also be appreciated from the aforenoted description of the embodiments of the invention, the rotation of the rotatable shaft and, thus, the operation of the control system for the covering is very simply achieved with a minimally sized helix and a relatively small number of parts so as to require minimal dexterity of an operator.

Although the present invention has been described with a certain degree of particularity, it is understood that the present disclosure has been made by way of example, and changes in detail or structure may be made without departing from the spirit of the invention as defined in the appended claims.

What is claimed is:

1. In combination, a covering for an architectural opening wherein said covering includes a rotatable shaft and a drive system for impararting a rotational drive to said rotatable shaft, said drive system comprising, in combination, an elongated hollow intermediate shell having an interior, a first end, and a second end, wherein said first end of said intermediate shell has at least one transverse circular opening therethrough;

an elongated drive rod rotatably positioned within said interior of said intermediate shell and adapted to be operatively connected to said rotatable shaft for unitary rotation therewith, said drive rod having a length and defining at least one helical guide path along its said length; and at least one rotatable bearing rotatably supported in said at least one circular opening at said first end of said intermediate shell, wherein said at least one circular opening is cupped to rotatably retain said at least one rotatable bearing in operative engagement with said at least one helical guide path, such that linear movement of said intermediate shell along said length of said drive rod effects relative rotational movement between said intermediate shell and said drive rod.

2. The drive system of claim 1, wherein said at least one circular opening through said first end of said intermediate shell comprises four circular openings that ate circumferentially spaced approximately 90° from each other, and wherein said at least one rotatable bearing comprises four ball bearings, each ball bearing rotatably supported by one of said four circular openings.

3. The drive system of claim 2, wherein said drive rod has a lower end, and wherein said lower end of said drive rod has an enlarged disc secured thereto, a circumferential edge of said enlarged disc in close sliding engagement with said interior of said intermediate shell to maintain a desired axial alignment of said intermediate shell with said drive rod, and further wherein said enlarged disc defines a lowest point of travel of said intermediate shell relative to said drive rod.

4. The drive system of claim 2 further comprising an elongated operating shaft having an upper end frictionally received through said second end and within said interior of said intermediate shell for unitary movement therewith.

5. In combination, a covering for an architectural opening wherein said covering includes a rotatable shaft and a drive system for imparting a rotational drive to said rotatable shaft, said drive system comprising, in combination, an elongated hollow outer shell having at least one open end, an elongated hollow intermediate shell slidably disposed within said outer shell, an elongated drive rod rotatively positioned within said intermediate shell and adapted to be operatively connected to said rotatable shaft for unitary rotation therewith, said drive rod having a length and defining at least one helical guide path along its length, and low friction means supported by said intermediate shell in operative engagement with said guide path such that linear movement of said intermediate shell along the length of said drive rod will effect relative rotational movement between said intermediate shell and said drive rod.

6. The drive system of claim 5 wherein said lower friction means are rotatable bearings.

7. The drive system of claim 6 wherein said rotatable bearings are ball bearings.

8. The drive system of claim 5 wherein said drive rod is of square cross section so as to have four sides and is twisted along its length such that each side of said drive rod defines said helical guide path.

9. The drive system of claim 8 wherein said low friction means are ball bearings and there is a ball bearing associated with each of said sides of said drive rod.

10. The drive system of claim 9 wherein said outer shell serves as an outer race for said ball bearings and said sides of said drive rod serve as an inner race for said ball bearings, and wherein said intermediate shell includes openings therethrough in which said ball bearings are rotatably seated.

11. The drive system of claim 5 wherein said drive rod is axially aligned with said rotatable shaft, and wherein said drive system further comprises a connector adapted to connect said drive rod and said rotatable shaft so as to permit adjustment of an axial spacing between said drive rod and rotatable shaft.

12. In combination, a covering for an architectural opening wherein said covering includes a rotatable shaft and a drive system for impairing a rotational drive to said rotatable shaft, said drive system comprising, in combination, an elongated hollow outer shell having a cylindrical main body with an inner surface and at least one open end;

an elongated hollow intermediate shell having an interior, a first end, and a second end, said first end slidably extending through said at least one open end of said outer shell and into said outer shell;

an elongated drive rod rotatably positioned within said intermediate shell and adapted to be operatively connected to said rotatable shaft for unitary rotation therewith, said drive rod having a length and defining at least one helical guide path along its said length; and at least one rotatable bearing supported by said first end of said intermediate shell and in operative engagement with said at least one helical guide path for rotation between an inner race defined by said at least one helical guide path and an outer race defined by said inner surface of said outer shell, such that linear movement of said intermediate shell along said length of said drive rod effects relative rotational movement between said intermediate shell and said drive rod.

13. The drive system of claim 12, wherein said first end of said intermediate shell has four circular openings therethrough that are circumferentially spaced 90° from each other, and wherein said at least one rotatable beating comprises four ball bearings rotatably supported by said four circular openings.

14. The drive system of claim 12, wherein said drive rod is twisted, square stock material, and wherein said at least one helical guide path comprises four helical guide paths, each side of said drive rod defining one of said four helical guide paths along said length of said drive rod.

15. The drive system of claim 12, wherein said drive rod has a lower end, and wherein said lower end of said drive rod has an enlarged disc secured thereto, a circumferential edge of said enlarged disc in close sliding engagement with said interior of said intermediate shell to maintain a desired axial alignment of said intermediate shell with said drive rod and said outer shell.

16. In combination, a covering for an architectural opening wherein said covering includes a rotatable shaft and a drive system for imparting a rotational drive to said rotatable shaft, said drive system comprising, in combination, an elongated hollow outer shell having a cylindrical main body with an inner surface and at least one open end;

an elongated hollow intermediate shell having an interior, a first end, and a second end, said first end slidably extending through said at least one open end of said outer shell and into said outer shell;

an elongated drive rod rotatably positioned within said intermediate shell and adapted to be operatively connected to said rotatable shaft for unitary rotation therewith, said drive rod having a length and defining at least one helical guide path along its said length, said drive rod having an enlarged cylinder secured thereto wherein said enlarged cylinder includes a protruding helical rib and circumferentially-spaced, longitudinally-extending grooves, and wherein said drive system further comprises a connector adapted to connect said drive rod and said rotatable shaft for unitary rotation while facilitating adjustment of an axial spacing between said drive rod and rotatable shaft; and at least one rotatable bearing supported by said first end of said intermediate shell and in operative engagement with said at least one helical guide path for rotation between an inner race defined by said at least one helical guide path and an outer race defined by said inner surface of said outer shell, such that linear movement of said intermediate shell along said length of said drive rod effects relative rotational movement between said intermediate shell and said drive rod.

17. The drive system of claim 16, wherein said connector comprises a hook- and-coil combination and a set screw.

18. The drive system of claim 17, wherein said hook-and-coil combination comprises a hook at a top of said hook-and-coil combination, said hook being adapted to be received in a transverse hole in said rotatable shaft, said hook-and-coil combination being thereby adapted to rotate in unison with said rotatable shaft; and a coil having a slightly larger internal diameter than an outside diameter of said enlarged cylinder so as to be operatively engageable with said helical rib on said enlarged cylinder; and said set screw is threaded through said cylindrical main body of said outer shell and is selectively received in one of said longitudinal grooves in said enlarged cylinder.

19. The drive system of claim 18 further comprising an elongated operating shaft having an upper end frictionally received within said interior of said intermediate shell for unitary movement therewith.

* * * * *